US010456618B2

(12) United States Patent
Carnago et al.

(10) Patent No.: US 10,456,618 B2
(45) Date of Patent: Oct. 29, 2019

(54) PORTABLE EXERCISE APPARATUS

(71) Applicants: Hal Medi Carnago, Englefeld (CA); Vincent Anthony Colistro, Saskatoon (CA)

(72) Inventors: Hal Medi Carnago, Englefeld (CA); Vincent Anthony Colistro, Saskatoon (CA)

( * ) Notice: Subject to any disclaimer, the term of this patent is extended or adjusted under 35 U.S.C. 154(b) by 79 days.

(21) Appl. No.: 15/918,118

(22) Filed: Mar. 12, 2018

(65) Prior Publication Data

US 2019/0160330 A1 May 30, 2019

Related U.S. Application Data

(60) Provisional application No. 62/592,133, filed on Nov. 29, 2017.

(51) Int. Cl.

| | |
|---|---|
| ***A63B 22/20*** | (2006.01) |
| ***A63B 21/04*** | (2006.01) |
| ***A63B 21/00*** | (2006.01) |
| ***A63B 21/055*** | (2006.01) |

(52) U.S. Cl.

CPC ..... *A63B 22/203* (2013.01); *A63B 21/0428* (2013.01); *A63B 21/0555* (2013.01); *A63B 21/4034* (2015.10); *A63B 21/4045* (2015.10); *A63B 2210/50* (2013.01)

(58) Field of Classification Search

CPC ..... A63B 22/02; A63B 21/40; A63B 21/05; A63B 2210/05

See application file for complete search history.

(56) References Cited

U.S. PATENT DOCUMENTS

| | | | | |
|---|---|---|---|---|
| 3,363,335 A * | 1/1968 | Burhns | A61H 1/02 | 434/255 |
| 3,582,069 A * | 6/1971 | Flick | A63B 21/154 | 482/70 |
| 3,589,720 A * | 6/1971 | Agamian | A63B 21/012 | 482/114 |
| 4,364,559 A * | 12/1982 | Valentine | A63B 21/055 | 482/130 |
| 4,799,475 A * | 1/1989 | Iams | A63B 23/0355 | 434/255 |
| 5,279,531 A * | 1/1994 | Jen-Huey | A63B 23/0417 | 482/51 |

(Continued)

*Primary Examiner* — Garrett K Atkinson

(74) *Attorney, Agent, or Firm* — Adrian D. Battison; Ade & Company Inc.; Kyle R. Satterthwaite

(57) ABSTRACT

An exercise apparatus for use in for example a leg exercise comprises a pair of tracks extending in a respective longitudinal direction, each carrying in sliding movement thereallong a limb receiving member for supporting a limb of the user. The tracks are interconnected by a bridging portion comprising a hinge which defines a central folding axis parallel to the respective longitudinal direction of each track, so that the tracks can be moved between an operating position in which the folding axis is located transversely between the tracks and a storage position in which the tracks are disposed so that upper load bearing surfaces are oriented so as to face one another. The apparatus also includes a resiliently deformable elastic band defining a limit in the range of sliding movement of each limb receiving member along the track so as to apply gradual resistance to the limb receiving member upon contact with same.

8 Claims, 6 Drawing Sheets

(56) References Cited

U.S. PATENT DOCUMENTS 5,503,609 A * 4/1996 Bull ..... A63B 21/154 482/51
6,368,254 B1 * 4/2002 Wall ..... A63B 21/055 482/122
7,462,139 B2 * 12/2008 Stafiej ..... A63B 22/02 482/51
7,951,050 B2 * 5/2011 Raumann ..... A63B 22/0015 482/51
8,944,970 B2 * 2/2015 Raumann ..... A61H 1/0259 482/51
9,079,071 B2 * 7/2015 Allain ..... A63B 21/023
9,630,056 B2 * 4/2017 Rao ..... A63B 71/0054
2001/0036885 A1 * 11/2001 Castellot, Jr. ..... A63B 21/012 482/79
2003/0119635 A1 * 6/2003 Arbuckle ..... A63B 22/0087 482/142
2008/0015095 A1 * 1/2008 Savsek ..... A63B 21/0455 482/121
2008/0248935 A1 * 10/2008 Solow ..... A63B 21/023 482/142
2009/0098983 A1 * 4/2009 Hoffman ..... A63B 21/055 482/70
2009/0105050 A1 * 4/2009 Mayo ..... A63B 21/06 482/70
2010/0248919 A1 * 9/2010 Zhou ..... A63B 21/154 482/139
2011/0039667 A1 * 2/2011 Teng ..... A63B 23/03541 482/142
2012/0108405 A1 * 5/2012 Milo ..... A63B 22/0087 482/142
2012/0244998 A1 * 9/2012 Rao ..... A63B 71/0054 482/70
2012/0277079 A1 * 11/2012 Allain ..... A63B 21/023 482/142
2014/0309091 A1 * 10/2014 Tang ..... A63B 21/0552 482/130
2015/0065311 A1 * 3/2015 Rao ..... A63B 71/0054 482/70

* cited by examiner

PORTABLE EXERCISE APPARATUS

This applications claims the benefit under 35 U.S.C. 119(e) of U.S. Provisional application Ser. No. 62/592,133 filed Nov. 29, 2017.

FIELD OF THE INVENTION

The present invention relates generally to an exercise apparatus which is portable and which is particularly but not exclusively suited for leg exercise, and more particularly to such an exercise apparatus which can be folded into a storage position so as to be rendered portable and which is non-motorized so that the user employs manual human input to displace his/her limbs placed on the exercise apparatus.

BACKGROUND

In the field of exercise equipment, there are a variety of exercise apparatuses or devices particularly suited for leg exercises which, generally speaking, are non-motorized thereby requiring user input to displace his/her feet in the prescribed, predetermined, or guided foot movement provided for by the exercise apparatus. A well-known example is a machine known under the trade name of Pro Skier manufactured by NordicTrack. This machine provides linear sliding movement of the feet of a user, similar to cross-country skiing. However, this machine is large, bulky, and clearly not meant to be portable. Additionally, a user is intended to be standing with weight fully carried by the device in the forgoing example.

Another example of leg exercise equipment is known under the trade name HappyLegs and LegXercise, each of which is a different machine marketed by a different manufacturer, but both of which provide a pair of limb pads which are guided in reciprocating back-and-forth movement along tracks by an electric motor. These are much smaller in size than a non-motorized machine like the Pro Skier marketed by NordicTrack, but they require an electrical outlet to receive power for operation. Furthermore, these devices cannot be rearranged into a more compact configuration for storage or transportation. Thus, these machines are not suitably portable. Users of HappyLegs or LegXercise operate the equipment from a seated position. There is considerable inactivity associated with spending significant portions of time seated, which may cause leg/foot fatigue, swollen feet, cold feet, sore joints, and possibly blood clotting.

SUMMARY OF THE INVENTION

According to an aspect of the invention there is provided an exercise apparatus comprising:

a pair of tracks each extending in a respective longitudinal direction from a first end of a respective one of the tracks to a second end thereof, each one of the tracks including an inner side and an outer side each spanning from the first end to the second end of the respective one of the tracks;

a pair of limb receiving members defining top support surfaces for receiving limbs of a user and each having first and second ends spaced apart in the respective longitudinal direction of the pair of tracks by a smaller distance than between the first and second ends of the respective one of the pair of tracks;

the pair of limb receiving members each being operatively coupled to the respective one of the pair of tracks so as to be slidable relative thereto between the first end of the respective one of the tracks and the second end thereof;

the pair of tracks comprising upper load bearing surfaces supporting the limb receiving members and lower surfaces adapted for resting on a support surface in an operating position of the exercise apparatus;

the pair of tracks being oriented substantially parallel to one another such that the respective longitudinal directions of the tracks are oriented substantially parallel to one another;

the pair of tracks being interconnected by a bridging portion which spans from the inner side of one of the tracks to the inner side of the other one of the tracks;

the bridging portion comprising a hinge defining a folding axis oriented substantially parallel to each one of the respective longitudinal directions of the tracks so that the tracks are movable between the operating position in which the pair of tracks are located in spaced relation from one another with respect to a transverse direction which is cross-wise to the respective longitudinal directions of the pair of tracks such that the inner sides of the tracks are spaced from one another in the transverse direction and the folding axis is located centrally between the tracks with respect to the transverse direction, and a storage position in which the tracks are disposed with the upper load bearing surfaces or the lower surfaces facing one another and the folding axis is located transversely outwardly from the pair of tracks.

According to another aspect of the invention there is provided an exercise apparatus comprising:

at least one track extending in a respective longitudinal direction from a first end of the at least one track to a second end thereof, the at least one track including first and second sides spanning between the first and second ends;

at least one foot receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto between the first end and the second end of the at least one track;

the at least one track comprising an upper load bearing surface respectively supporting the at least one limb receiving member and a lower surface adapted for resting on a support surface;

an elastic band spanning from the first side to the second side of the at least one track at or adjacent one of the first and second ends of the at least one track, the elastic band having a top edge spaced above the upper load bearing surface and an inner band surface extending from the top edge downwardly so as to be upstanding relative to the upper load bearing surface;

the inner band surface being communicated with a sliding area defined over the upper load bearing surface of the at least one track so as to be adapted for engaging one of the first end of the at least one limb receiving member and the second end thereof;

the elastic band being resiliently deformable in the respective longitudinal direction of the at least one track which is transverse to the inner band surface, so as to provide gradual resistance to sliding movement of the limb receiving member in the respective longitudinal direction upon contact with the inner band surface of the elastic band.

Preferably the limb receiving members are configured for free sliding movement relative to the tracks without a motor driving the sliding movement.

Preferably, in the operating position of the exercise apparatus, the folding axis is arranged to lie in a common plane with the top support surfaces of the limb receiving members which are substantially planar and lie in the common plane with one another, so that in the storage position of the exercise apparatus the top support surfaces of the limb receiving members are enabled to contact one another.

In one arrangement the inner band surface of the elastic band follows a convex arcuate path from the first side to the second side of the at least one track relative to the longitudinal direction thereof.

In such an arrangement an end of the limb support member adapted for contacting the inner band surface may follow a convex arcuate path from a first side of the limb support member to a second side thereof which are respectively adjacent the first and second sides of the at least one track so as to substantially conform to a side-to-side shape of the inner band surface.

In one arrangement the at least one track comprises a wall on at least one of the first and second sides of the upper load bearing surface so as to define a channel, the channel defined by the at least one track being open at one or more of the first and second ends of the at least one track, and wherein the elastic band closes said one or more of the first and second ends.

BRIEF DESCRIPTION OF THE DRAWINGS

The invention will now be described in conjunction with the accompanying drawings in which.

In the drawings like characters of reference indicate corresponding parts in the different figures.

DETAILED DESCRIPTION

Figure 1:
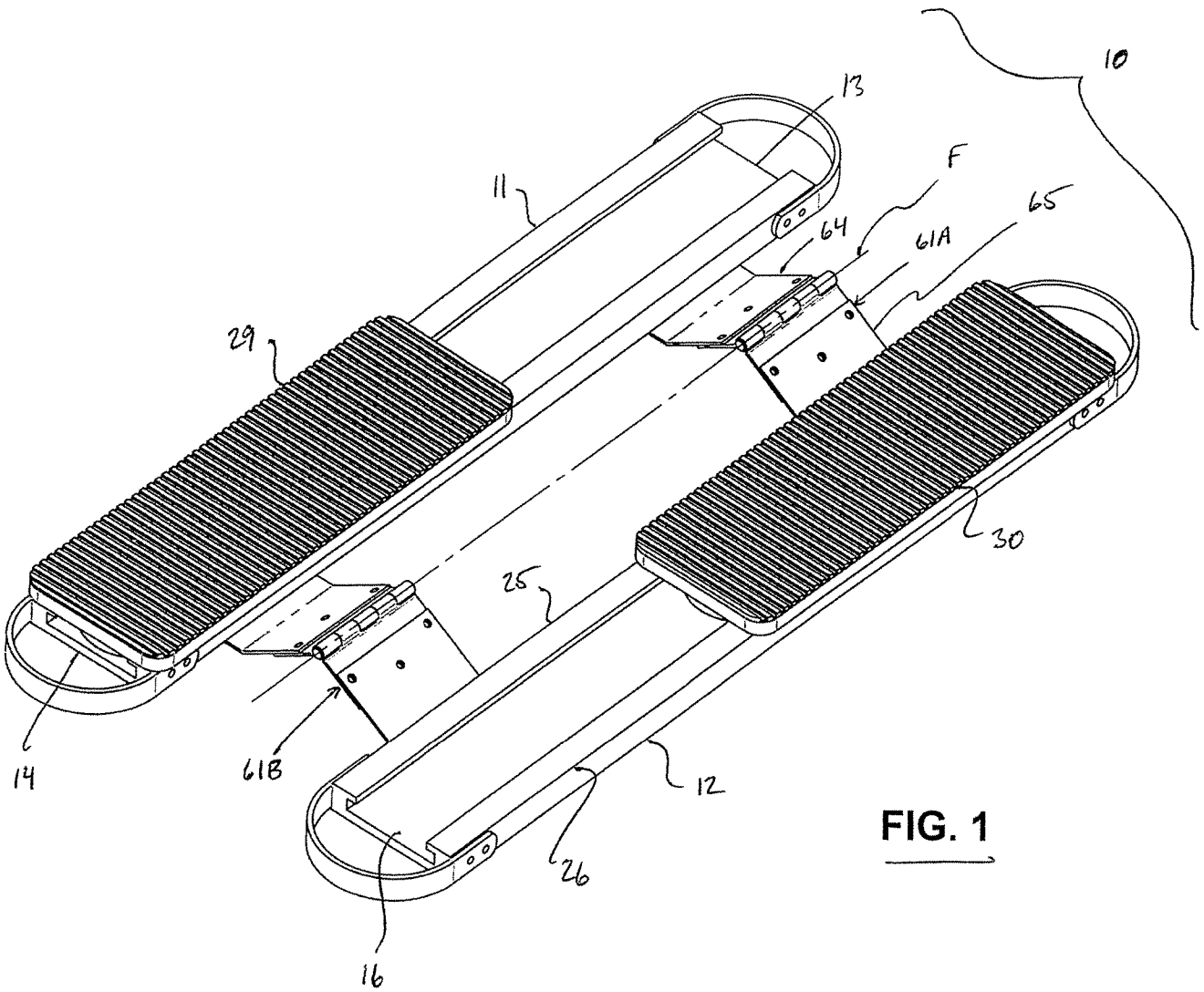
FIG. 1 is a perspective view of an arrangement of exercise apparatus according to the present invention.

The accompanying figures show an exercise apparatus 10 which is particularly but not exclusively suited for use in an exercise in which feet of a user (not shown) are placed on the apparatus and each displaced in reciprocating linear movement along the apparatus, as will be described in more detail shortly. It is possible that the exercise apparatus may be used in a manner instead receiving hands of a user for movement thereof in the reciprocating linear fashion.

Regardless of how the apparatus is intended to be used, the apparatus 10 comprises a pair of tracks 11 and 12 which are linearly elongated in a respective longitudinal direction of each track and thus extend linearly from a first end 13 to a second end 14. In either illustrated arrangement the tracks are in the form of channels with a bottom base wall 16 defining a planar upper load bearing surface 17 and a lower surface 18 which is adapted for resting on a support surface, for example by being shaped flat and planar or by a plurality of feet (not shown) carried in spaced relation on the lower surface 18. The tracks are open at opposite longitudinally spaced-apart ends 13 and 14 and comprise side walls 25 and 26 upstanding from the base wall 16 defining laterally opposite sides of the tracks.

The exercise apparatus 10 further includes a pair of limb receiving members in the form of pads 29 and 30 which are operatively coupled to the tracks 11 and 12 so as to be slidable relative thereto between the first and second ends 13, 14. Each pad 29, 30 comprises a coupling portion 31 (shown in stippled line) which is arranged for coupling to the tracks, and an upper portion 32 which carries at its top a support surface 32A for receiving a limb of a user, for example a foot or a hand.

In the first illustrated arrangement of FIGS. 1-4, the side walls of the respective track comprise interior side surfaces 33 which extend vertically upwardly from the upper load bearing surface 17 of the base channel wall. At a top of each side wall 25, 26 there is provided a retaining portion 35 which extends inwardly towards a (imaginary) longitudinally extending center line 36 of the respective track such that there is defined at a bottom of the retaining portion 35 a horizontal surface which meets the interior side surface 90 at a right angle.

Thus the coupling portion 31 comprises an enlarged base 38 (shown in phantom) spanning a majority of the interior width of the track between opposite interior side surfaces 33 and defining a bottom surface 38A which is in sliding contact with the load bearing surface 17 of the track.

The coupling portion further includes a neck 41 which is narrower in width than the base 38 so as to fit between vertically upright inner side surfaces 44 of the retaining portions of the track side walls.

Thus in the first illustrated arrangement, the pads 29, 30 are operatively coupled to the tracks 11, 12 by cooperating interlocking shapes which prevent each pad from being lifted upwardly out of the channel defined by the respective track.

The upper portion 32 of the respective limb pad extends in a width direction, transverse to the longitudinal direction of the track, beyond the neck 41 and beyond the base 38 so as to form the widest part of the limb pad. Thus the upper portion comprises bottom surfaces 45 which can come into sliding contact with upper surfaces 46 of the side walls of the track.

Each sliding interface between the respective pad and track comprises low-friction material, such as silicone, in a film or layer across each surface, and that portion thereof, defining the interface so as to allow the pad to slide freely along the track. Thus in some arrangements where the bottom surfaces 45 of the upper support portion 32 of the respective are in sliding contact with the upper surfaces 46 of the track side walls 25, 26 there may be low-friction material at this interface between these two types of surfaces.

At each open end of the track there is provided an elastic band 49 coupled at either side thereof to an outer surface of each side wall 25, 26 of the track so as to span from one side of the track to the other and span a full width between the interior side surfaces 33 between which the base 38 of the limb pad extends.

The elastic band 49 comprises a thin strip of rubber material oriented vertically upright so as to define a vertically upright inner band surface 51 facing towards the proximal and adjacent open end 13 or 14 of the track and thus communicated with a sliding area of the track defined over or vertically above the upper load bearing surface 17 where the limb pad is carried by the track in sliding movement therealong. The inner band surface 51 is vertically upstanding relative to the load bearing surface 17 of the track and extends above the load bearing surface to a top edge 54 spaced above this surface. In other words, the inner band surface extends from the top edge 54 downwardly towards the upper load bearing surface 17 so as to be upstanding relative thereto.

In the first illustrated arrangement the whole of the elastic band 49 follows a convex arcuate path from the first side to the second side of the track relative to the longitudinal direction thereof, such that the inner band surface 51 follows same.

The elastic band 49 is resiliently deformable in the longitudinal direction of the track so that upon contact with an end 57, 58 of the limb pad the band 49 acts to stretch away from the proximal end 13 or 14 of the track providing gradual resistance to the limb pad still being displaced longitudinally in that direction, until the band can no longer stretch so as to define a limit in the sliding range of movement of the limb pad.

An elastic band is provided at either end 13, 14 of the track to provide the gradual resistance and braking of the sliding movement of the respective limb pad and to define a limit in this movement at both ends of the track.

The enlarged base 38 of the respective limb pad's coupling portion is sized slightly larger in length in the longitudinal direction of the respective track than the neck 41, and thus although the top edge 54 is located above a top of the enlarged base including a top edge and top surface of the enlarged base, it is the base 38 of the limb pad's lower coupling portion which defines the end 57, 58 of the limb pad that contacts the inner band surface 51. As such both ends 57, 58 of the enlarged base 38 are curved convexly relative to the respective longitudinal direction of the track to which the respective pad is coupled so as to substantially conform to the shape of the inner band surface 51.

The upper portion 32 of each pad is substantially rectangular shaped in plan view and extends not only in the width direction but also in the length direction beyond ends 57, 58 of the enlarged base of the respective pad.

In the illustrated arrangements both limb pads 29, 30 freely slide along the tracks and are not driven by any motor. Thus there is no power source for connecting to in order to operate the apparatus 10, rather the limb pads are displaced by manual input from the user to move his/her feet in the reciprocating linear movement defined by the shape of the tracks.

Thus the apparatus is suited for use anywhere and to be portable as it does not require a power source to enable the sliding movement of the limb pads.

So as to further enhance portability of the apparatus 10, the tracks are interconnected by a foldable bridging portion 61 spanning from an inner one 25 of the sides of a first track 11 to an inner one of the sides of a second track 12.

The bridging portion 61 comprises in the illustrated arrangements two sets 61A and 61B of frame members interconnecting the tracks 11, 12 at longitudinally spaced positions relative to the tracks. Each set of frame members 61A, 61B includes a pair of brackets 64, 65 which in the illustrated arrangements are respectively connected to the lower surface 18 of the base wall of the respective track and extend perpendicularly transversely from connection to the base wall in a laterally inward direction towards the opposite track which in an operating position of the apparatus is arranged so that the top limb-receiving surfaces 32A of the limb pads are coplanar, as more clearly shown in FIG. 2.

Figure 5:
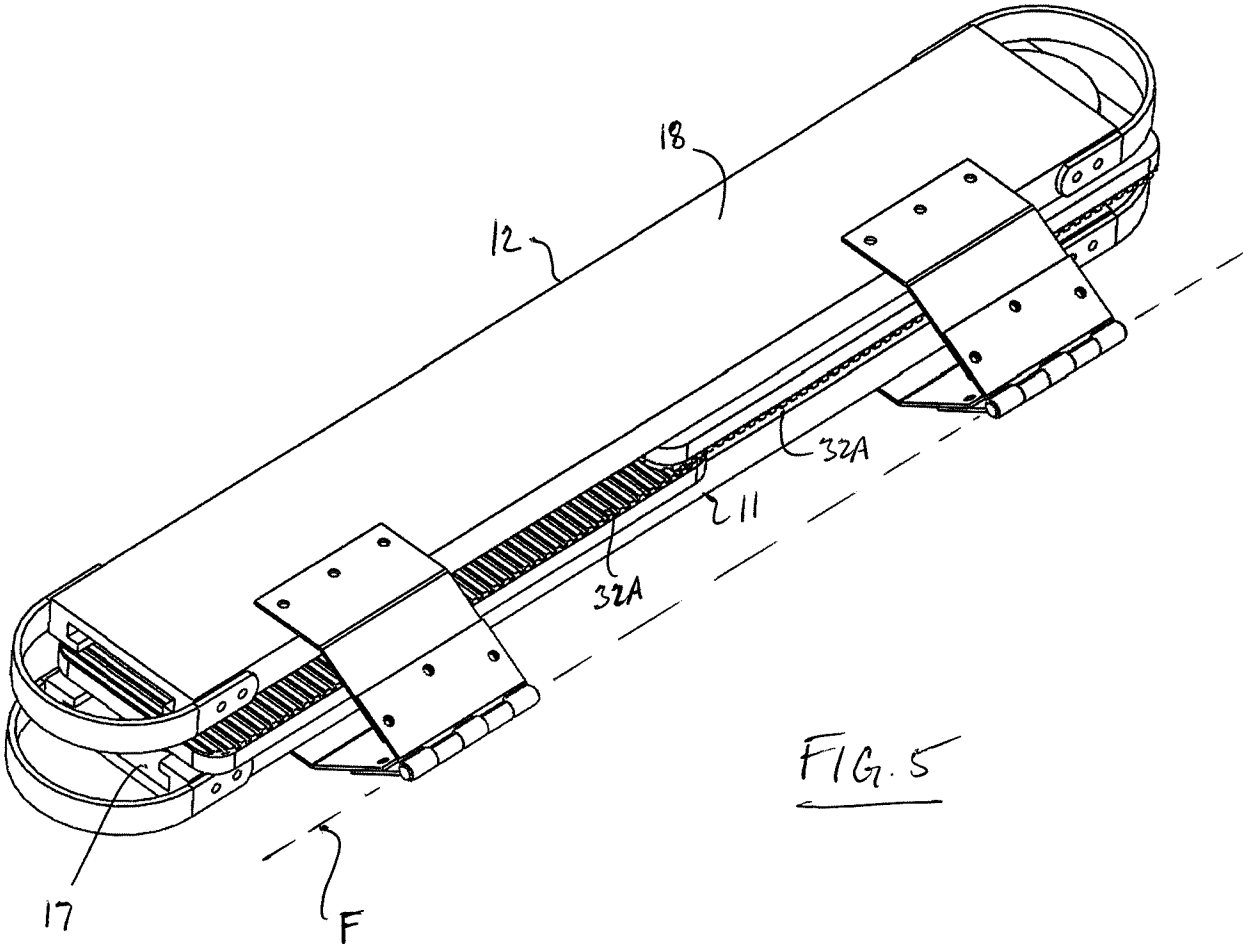
FIG. 5 is a perspective view of the arrangement of FIG. 1 disposed in a storage position.

In either the operating position as shown in FIG. 1, for example, or a storage position of the exercise apparatus which is shown in FIG. 5 and which will be discussed in more detail shortly, the pair of tracks 11, 12 are mounted to the frame members so as to be wholly oriented parallel to one another, since each track is linearly elongated. Thus the tracks are oriented relative to one another such that the respective longitudinal directions of the tracks are parallel to one another.

Each pair of brackets 64, 65 of each set of frame members 61A, 61B are interconnected by a hinge 68 which define a common folding axis F oriented parallel to each one of the respective longitudinal directions of the tracks and to the tracks themselves, which are linearly elongated along a respective longitudinal axis indicated at 36. As such the tracks 11, 12 are movable relative to one another in pivotal movement about the folding axis F between the operating position and the storage position. In the operating position, the tracks 11, 12 are located in spaced relation from one another relative to the transverse direction which is crosswise to the respective longitudinal directions of the tracks such that inner sides 25 of the tracks are spaced from one another in the transverse direction, and the folding axis F is located centrally halfway between the tracks with respect to the transverse direction. In the storage position as shown in FIG. 5, the tracks 11, 12 are disposed with the upper load bearing surfaces 17 oriented so as to face one another so that the top limb-receiving surfaces 32A of the pads can be brought to touch if the pads are located at longitudinally coinciding positions along the tracks, and the folding axis F is located transverse outwardly from the tracks 11, 12. In the storage position of other arrangements, the tracks are displaced about the folding axis such that their lower surfaces 18 are oriented so as to generally face one another.

Figure 2:
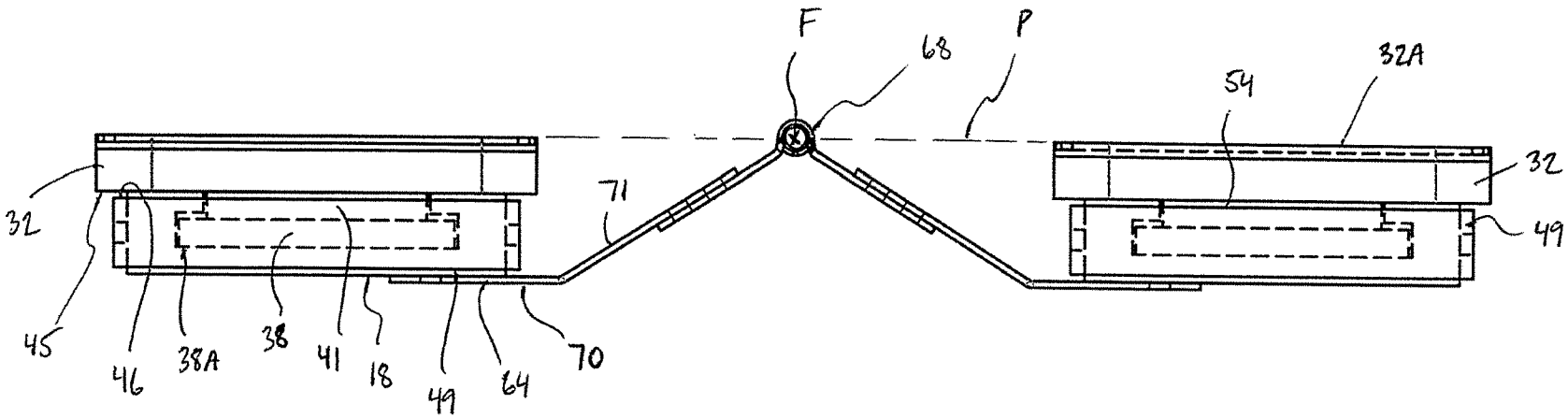
FIG. 2 is a top plan view of the arrangement of FIG. 1.
Figure 3:
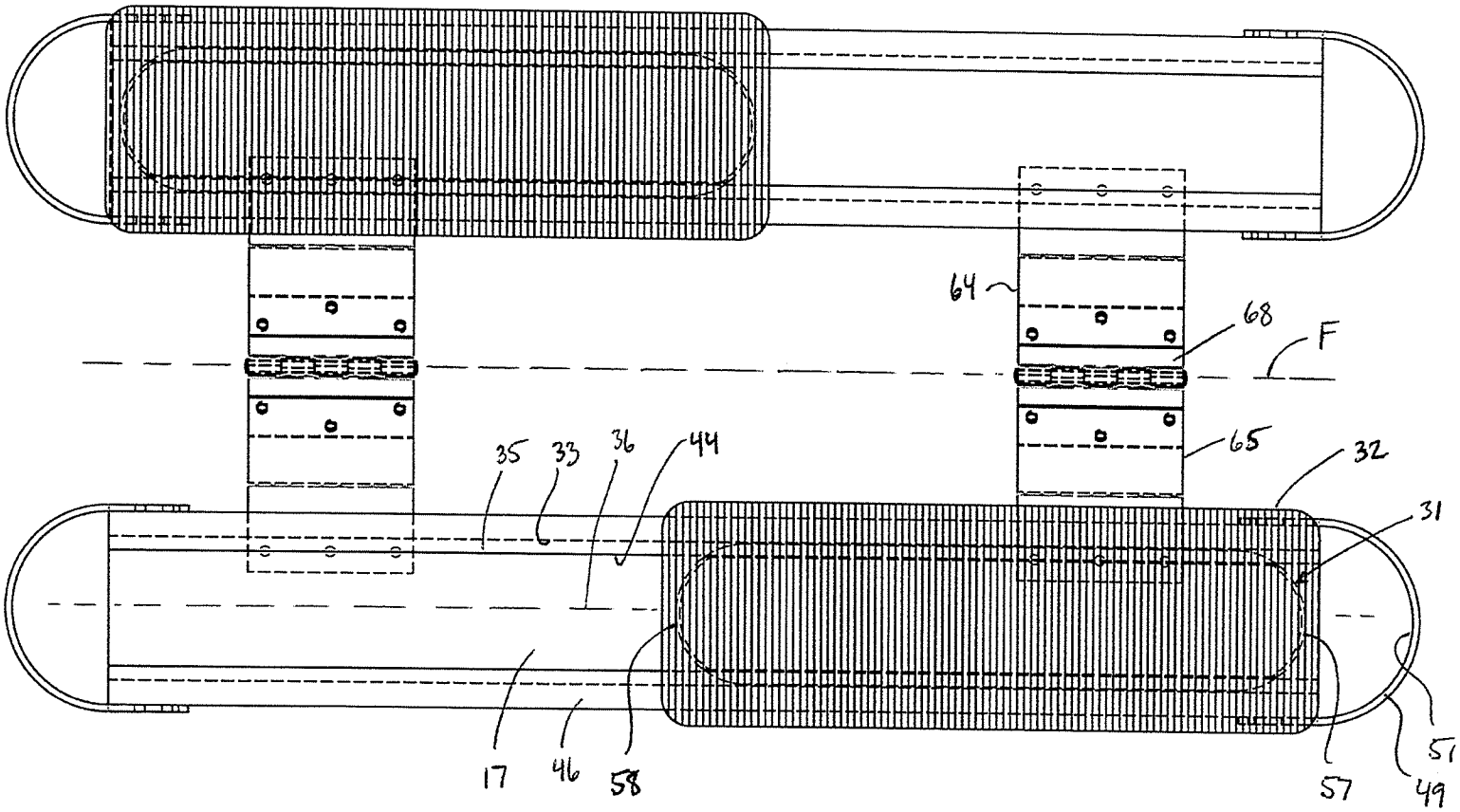
FIG. 3 is a side elevational view of the arrangement of FIG. 1.
Figure 4:
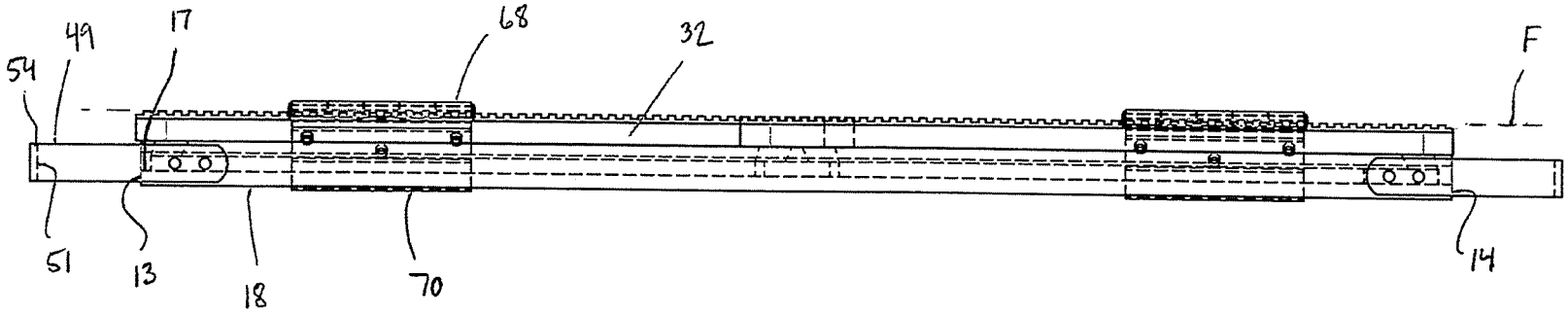
FIG. 4 is an end view of the arrangement of FIG. 1.

As more clearly shown in FIG. 2, the pair of hinges 68 are each located at a height spaced above the lower surface 18 of the tracks so as to locate in the operating position the common folding axis F defined by the hinges at a height where the axis F lies in a common plane P with the top limb-receiving support surfaces 32A of the pads 29, 30. Thus the exposed top surfaces 32A of the pads can be arranged flat against each other in the storage position of the apparatus. That is, in the storage position the folding axis lies in a plane lying in between the top surfaces 32A of either pad. In order to locate the folding axis F coplanar with the exposed limb-receiving surfaces 32A of the pads, each bracket 64, 65 mounted to the lower surface 18 of the respective track has a planar horizontal portion 70 generally parallel to the planar lower surface 18 of that track and then a planar inclined portion 71 which is inclined relative to the horizontal bracket portion 70 upwardly and inwardly towards the opposite track. It is to this inclined bracket portion 71 that the hinge is mounted.

Figure 6:
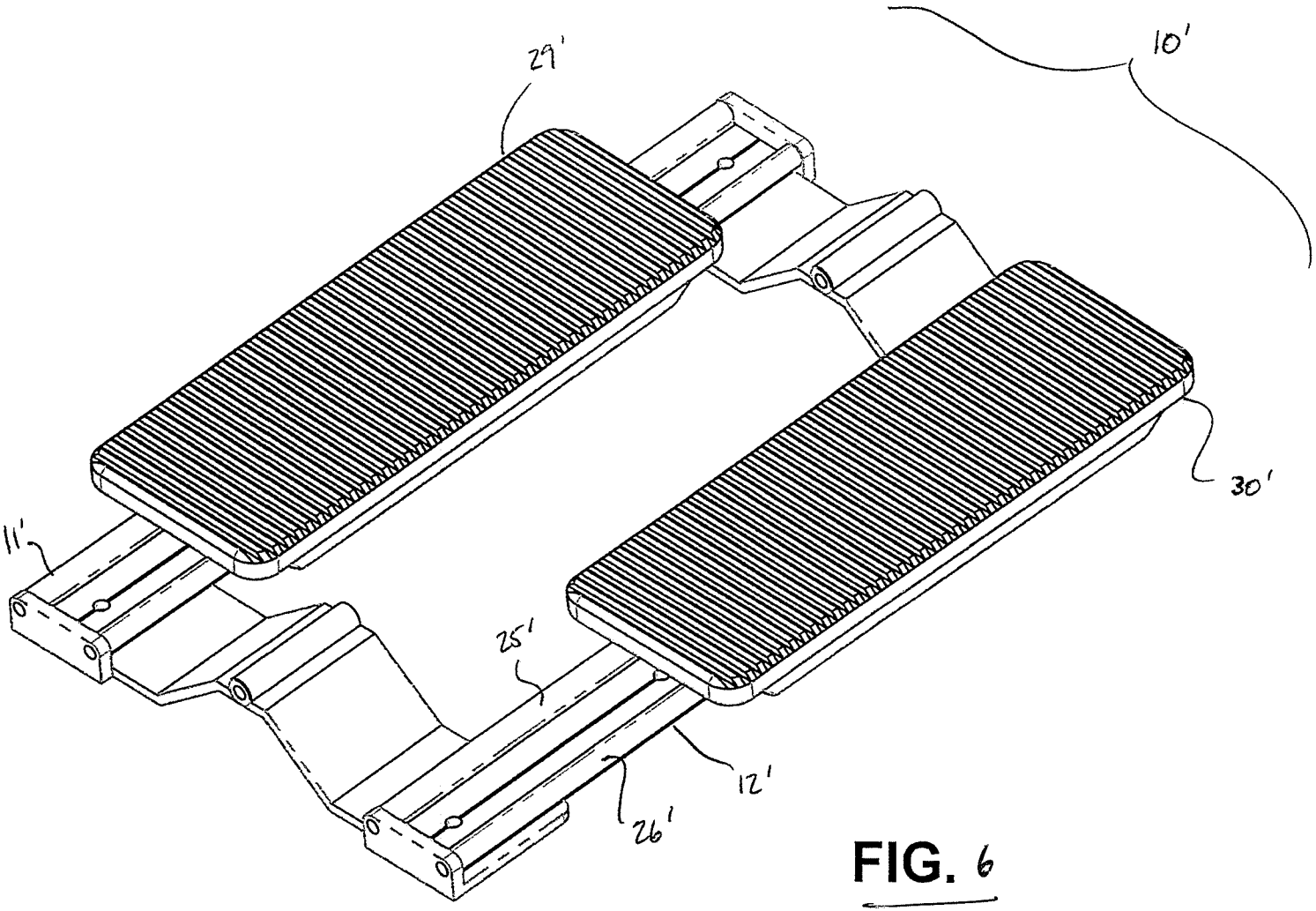
FIG. 6 is a perspective view of another arrangement of exercise apparatus according to the present invention.

Referring now to FIG. 6, this figures illustrates another arrangement of apparatus 10' which excludes the elastic bands 49 of the first arrangement 10 and which employs a different track structure 11', 12' and consequently limb support members which have coupling portions of a different structure to cooperate with the tracks 11', 12'. In the arrangement of FIG. 6, the respective track includes a base wall 16' with a pair of cylindrical side walls 25', 26' on which a pair of blocks with cylindrical bores are slidingly mounted, defining the coupling portion 31' of the pads 29', 30'. Thus the upper load bearing surfaces of the second arrangement are defined on tops of the cylindrical side walls 25', 26'. A remainder of the second arrangement 10' is substantially similar to the first arrangement 10 described in detail hereinbefore.

In use, the apparatus may be kept in the folded storage position in which the overall size of the apparatus is minimized until required for use. To move the apparatus from the storage position to the operating position, the tracks 11, 12 to which the limb receiving pads are coupled are manually moved apart from one another so as to swing each half of the apparatus about the common folding axis F into the operating position in which the tops 32A of the pads 29, 30 are coplanar. For use when arranged in the operating position the user places limbs, typically the feet, respectively onto the pads 29, 30 and proceeds to displace his/her feet along the tracks in the longitudinal directions thereof. When the respective pad reaches an elastic band, continuing displacement of the pan in the longitudinal direction towards the band acts to stretch the band away from the nearest end of the track. Once the band has been maximally stretched the limb pad cannot proceed in the same longitudinal direction any further, causing the user to displace his/her limb in the opposite direction along the track.

In the illustrated arrangements the hinge is not limited in its range of movement such that the tracks can be pivoted past the position where the tops 32A of the pads are coplanar, for example if the support surface beneath the apparatus is uneven.

The apparatus may enable the user to exercise their legs in a back and forth motion while sitting on a chair or on a bench, at a desk, or on an airplane or vehicle as a passenger. Thus exercises carried out on this apparatus may increase blood flow and heart rate to reduce leg/foot fatigue and reduce inactivity, particularly when an individual spends considerable time sitting whether for example at a desk or as a passenger in a motor vehicle or on an airplane.

The scope of the claims should not be limited by the preferred embodiments set forth in the examples but should be given the broadest interpretation consistent with the specification as a whole.

The invention claimed is:

1. An exercise apparatus comprising:

a pair of tracks each extending in a respective longitudinal direction from a first end of a respective one of the tracks to a second end thereof, each one of the tracks including an inner side and an outer side each spanning from the first end to the second end of the respective one of the tracks;

a pair of limb receiving members defining top support surfaces for receiving limbs of a user;

the pair of limb receiving members each being operatively coupled to the respective one of the tracks so as to be slidable relative thereto between the first end of the respective one of the tracks and the second end thereof;

the pair of tracks comprising upper load bearing surfaces supporting the limb receiving members in sliding contact therewith and lower surfaces adapted for resting on a support surface in an operating position of the exercise apparatus;

the pair of tracks being oriented substantially parallel to one another such that the respective longitudinal directions of the tracks are oriented substantially parallel to one another;

the pair of tracks being interconnected by a bridging portion which spans from the inner side of one of the tracks to the inner side of the other one of the tracks;

the bridging portion comprising a hinge defining a folding axis oriented substantially parallel to each one of the respective longitudinal directions of the tracks so that the tracks are movable between the operating position in which the pair of tracks are located in spaced relation from one another with respect to a transverse direction which is cross-wise to the respective longitudinal directions of the pair of tracks such that the inner sides of the tracks are spaced from one another in the transverse direction and the folding axis is located centrally between the tracks with respect to the transverse direction, and a storage position in which the tracks are disposed with the upper load bearing surfaces or the lower surfaces facing one another and the folding axis is located transversely outwardly from the pair of tracks.

2. The exercise apparatus of claim 1 wherein the limb receiving members are configured for free sliding movement relative to the tracks without a motor driving the sliding movement.

3. The exercise apparatus of claim 1 wherein, in the operating position of the exercise apparatus, the folding axis is arranged to lie in a common plane with the top support surfaces of the limb receiving members which are substantially planar and lie in the common plane with one another, so that in the storage position of the exercise apparatus the top support surfaces of the limb receiving members are enabled to contact one another.

4. An exercise apparatus comprising:

at least one track extending in a respective longitudinal direction from a first end of the at least one track to a second end thereof, the at least one track including first and second sides spanning between the first and second ends;

at least one foot receiving member defining a top surface for receiving a limb of a user and having first and second ends spaced apart in the respective longitudinal direction of the at least one track by a smaller distance than between the first and second ends of the at least one track;

the at least one limb receiving member being operatively coupled to the at least one track so as to be slidable relative thereto between the first end and the second end of the at least one track;

the at least one track comprising an upper load bearing surface respectively supporting the at least one limb receiving member in sliding contact therewith and a lower surface adapted for resting on a support surface;

an elastic band spanning from the first side to the second side of the at least one track at or adjacent one of the first and second ends of the at least one track, the elastic band having a top edge spaced above the upper load bearing surface and an inner band surface extending from the top edge downwardly so as to be upstanding relative to the upper load bearing surface;

the inner band surface being communicated with a sliding area defined over the upper load bearing surface of the at least one track so as to be adapted for engaging one of the first end of the at least one limb receiving member and the second end thereof;

the elastic band being resiliently deformable in the respective longitudinal direction of the at least one track which is transverse to the inner band surface, so as to provide gradual resistance to sliding movement of the limb receiving member in the respective longitudinal direction upon contact with the inner band surface of the elastic band.

5. The exercise apparatus of claim 4 wherein the limb receiving members are configured for free sliding movement relative to the tracks without a motor driving the sliding movement.

6. The exercise apparatus of claim 4 wherein the inner band surface of the elastic band follows a convex arcuate path from the first side to the second side of the at least one track relative to the longitudinal direction thereof.

7. The exercise apparatus of claim 6 wherein an end of the limb support member adapted for contacting the inner band surface follows a convex arcuate path from a first side of the limb support member to a second side thereof which are respectively adjacent the first and second sides of the at least one track so as to substantially conform to a side-to-side shape of the inner band surface.

8. The exercise apparatus of claim 4 wherein the at least one track comprises a wall on at least one of the first and second sides of the upper load bearing surface so as to define a channel, the channel defined by the at least one track being open at one or more of the first and second ends of the at least one track, and wherein the elastic band closes said one or more of the first and second ends.

* * * * *